US011021673B2

(12) United States Patent
Ueda et al.

(10) Patent No.: US 11,021,673 B2
(45) Date of Patent: Jun. 1, 2021

(54) LUBRICANT COMPOSITION

(71) Applicant: SHELL OIL COMPANY, Houston, TX (US)

(72) Inventors: Mao Ueda, Aikoi-Gun (JP); Kiyoshi Hanyuda, Aikoi-Gun (JP)

(73) Assignee: Shell Oil Company, Houston, TX (US)

( * ) Notice: Subject to any disclaimer, the term of this patent is extended or adjusted under 35 U.S.C. 154(b) by 142 days.

(21) Appl. No.: 16/461,024

(22) PCT Filed: Nov. 16, 2017

(86) PCT No.: PCT/EP2017/079486

§ 371 (c)(1),
(2) Date: May 15, 2019

(87) PCT Pub. No.: WO2018/091595

PCT Pub. Date: May 24, 2018

(65) Prior Publication Data

US 2019/0270948 A1 Sep. 5, 2019

(30) Foreign Application Priority Data

Nov. 17, 2016 (JP) ..... JP2016-224400

(51) Int. Cl.

| | |
|---|---|
| ***C10M 169/04*** | (2006.01) |
| ***C10N 30/02*** | (2006.01) |
| ***C10N 30/06*** | (2006.01) |
| ***C10N 30/12*** | (2006.01) |
| ***C10N 30/00*** | (2006.01) |
| ***C10N 40/25*** | (2006.01) |
| ***C10M 171/02*** | (2006.01) |
| ***C10M 145/14*** | (2006.01) |

(52) U.S. Cl.

CPC .... *C10M 169/048* (2013.01); *C10M 169/041* (2013.01); *C10M 169/044* (2013.01); *C10M 2205/173* (2013.01); *C10M 2209/084* (2013.01); *C10M 2229/041* (2013.01); *C10N 2030/02* (2013.01); *C10N 2030/06* (2013.01); *C10N 2030/12* (2013.01); *C10N 2030/43* (2020.05); *C10N 2030/45* (2020.05); *C10N 2030/54* (2020.05); *C10N 2030/68* (2020.05); *C10N 2040/25* (2013.01)

(58) Field of Classification Search

CPC ..... C10M 169/048; C10M 169/044; C10M 169/041; C10M 2205/173; C10M 2209/084; C10M 2229/041; C10N 2030/02; C10N 2030/06; C10N 2030/12; C10N 2030/43; C10N 2030/45; C10N 2030/54; C10N 2030/68; C10N 2040/25

See application file for complete search history.

(56) References Cited

U.S. PATENT DOCUMENTS

| | | | | |
|---|---|---|---|---|
| 6,479,571 | B1 * | 11/2002 | Cooke | C08K 9/04 523/205 |
| 2010/0190671 | A1 * | 7/2010 | Stoehr | C10M 143/12 508/469 |
| 2011/0306533 | A1 | 12/2011 | Eisenberg et al. | |
| 2013/0079265 | A1 * | 3/2013 | Eisenberg | C10M 149/00 508/500 |
| 2013/0196888 | A1 * | 8/2013 | Truong-Dinh | C10M 161/00 508/364 |
| 2015/0275130 | A1 * | 10/2015 | Willars | C10M 169/047 508/161 |
| 2016/0010023 | A1 | 1/2016 | Matthews et al. | |
| 2017/0009180 | A1 * | 1/2017 | Chen | C10M 169/041 |

FOREIGN PATENT DOCUMENTS

| | | | |
|---|---|---|---|
| DE | 102007032120 | A1 | 1/2009 |
| JP | 4133133 | B2 | 8/2008 |
| JP | 2010532805 | A | 10/2010 |
| JP | 2013536293 | A | 9/2013 |
| JP | 2014125569 | A | 7/2014 |
| JP | 2015196696 | A | 11/2015 |
| WO | 2013189951 | A1 | 12/2013 |
| WO | 2016043334 | A1 | 3/2016 |
| WO | 2016152679 | A1 | 9/2016 |

OTHER PUBLICATIONS

International Search Report and Written Opinion received for PCT Patent Application No. PCT/EP2017/079486, dated Jan. 31, 2018, 11 pages.

Trends of Environmentally Friendly Diesel Engines Oils, Journal of Japanese Society of Tribologists, vol. 59, Issue No. 7, 2014, p. 387.

* cited by examiner

*Primary Examiner* — Pamela H Weiss

(57) ABSTRACT

The invention provides a lubricating oil composition being a lubricating oil composition containing a base oil composition which includes a lubricant base oil belonging to Group 3 of the base oil categories specified by the American Petroleum Institute (API) and a comb-like polymethacrylate-based viscosity index improver wherein the weight-halving temperature is not less than 310° C., and the sulphur content in the aforementioned lubricating oil composition is not more than 0.3 weight % in terms of the total weight of the aforementioned lubricating oil composition, and the aforementioned lubricating oil composition has an SAE viscosity grade of 0W-20, 5W-20 or 5W-30, a viscosity index of not less than 185 and a high-temperature high-shear viscosity at 100° C. of not more than 7.5 mPa·s.

12 Claims, No Drawings

LUBRICANT COMPOSITION

CROSS REFERENCE TO EARLIER APPLICATION

The present application is the National Stage (§ 371) of International Application No. PCT/EP2017/079486, filed Nov. 16, 2017, which claims priority from JP Application 2016-224400, filed Nov. 17, 2016, incorporated herein by reference.

FIELD OF THE INVENTION

This invention relates to a fuel-saving type of lubricating oil composition and in particular relates to a fuel-saving type of lubricating oil composition for use in internal combustion engines with improved resistance to copper corrosion.

BACKGROUND OF THE INVENTION

In recent years, regulations such as those relating to emissions of carbon dioxide have become more rigorous because of environmental concerns such as preventing global warming. Fuel-saving measures in cars such as minimising car body weights and improving engine systems have made progress, and there have likewise been further developments even in fuel-saving oils such as in the lubricating oils used in engines.

High-output, high-efficiency diesel engines with higher thermal efficiencies have been developed with the aim of reducing fuel consumption. These engines use various metals such as iron, copper, aluminium, tin and lead, and there are times when problems occur when these metals corrode because of the lubricating oil and leach into the lubricant. Corrosion of these metals, and in particular copper, gives rise to problems such as deterioration of the engine efficiency or in the worst cases damage to the engines, and so there is a demand for corrosion resistance for these various metallic materials, but in particular for copper materials, within lubricating oils.

Japanese Laid-open Patent 2015-196696 therefore proposed an internal combustion engine lubricating oil composition containing (A) a lubricating oil base oil, (B) a boric acid-containing imide and (C) a poly(meth)acrylate. On the basis of said lubricating oil composition it is possible to inhibit the leaching of copper from engine parts.

Diesel engines are tending to have higher thermal loads and accordingly the base oils are being exposed to higher temperatures than ever. The inventors have discovered that, with the internal combustion engine lubricating oil composition of Japanese Laid-open Patent 2015-196696, if the thermal load of the engine is increased there are times when this causes an increase in the corrosion of copper-based materials in the engine. This invention therefore has as its primary objective to offer a lubricating oil composition which does not cause an increase in corrosion of copper-based materials in an engine even when the thermal load of the engine is increased, in other words a lubricating oil composition with improved resistance to copper corrosion.

In addition to being a lubricating oil composition having fuel-saving properties, this invention further has as a secondary objective to offer a lubricating oil composition which ensures copper corrosion resistance as well as having superior shear stability.

SUMMARY OF THE INVENTION

By dint of intensive investigations, the inventors have perfected this invention after discovering that it is possible to solve the aforementioned problems by incorporating in the lubricating oil composition a specific base oil and a specific viscosity index improver, giving a specific maximum value for the sulphur content, giving a specific SAE viscosity grade, making the viscosity index a specified minimum value, and also making the viscosity a specified maximum value.

More concretely, the invention provides a lubricating oil composition being a lubricating oil composition containing a base oil composition which includes a lubricant base oil belonging to Group 3 of the base oil categories specified by the American Petroleum Institute (API) and a comb-like polymethacrylate-based viscosity index improver wherein the weight-halving temperature is not less than 310° C., and the sulphur content in the aforementioned lubricating oil composition is not more than 0.3 weight % in terms of the total weight of the aforementioned lubricating oil composition, and the aforementioned lubricating oil composition has an SAE viscosity grade of 0W-20, 5W-20 or 5W-30, a viscosity index of not less than 185 and a high-temperature high-shear viscosity at 100° C. of not more than 7.5 mPa·s.

DETAILED DESCRIPTION OF THE INVENTION

The lubricating oil composition of this invention can inhibit corrosion of copper-based materials in engines even when the thermal load of the engine is high. In other words, it has the effect of improving resistance to copper corrosion. The lubricating oil composition of the invention can also achieve superior fuel savings and, in addition, can achieve superior shear stability.

The invention is explained in more detail below as regards composition of the lubricating oil composition pertaining to the invention (specific constituents and amounts of the various constituents in the blend), properties and applications, but the invention is not limited thereby.

Given first is an explanation of the constituents and blended amounts of the lubricating oil composition pertaining to the invention.

The base oil composition included in the lubricating oil composition of the invention is one which includes a lubricant base oil belonging to Group 3 in the base oil categories stipulated by the American Petroleum Institute (API). What is meant here by the base oil categories stipulated by the API are broad categories of base oil materials defined by the American Petroleum Institute in order to create guidelines for lubricant base oils.

As examples of Group 3 lubricant base oils, mention may be made of paraffinic mineral oils obtained by application of a high degree of hydrorefining of lubricating oil fractions obtained by atmospheric distillation of crude oil, base oils in which GTL (gas-to-liquid) waxes synthesised by the Fischer-Tropsch process, which is a technology for turning natural gas into a liquid fuel, or waxes formed in the course of dewaxing processes are refined by the Isodewaxing process, which further dewaxes and substitutes the wax with isoparaffins after solvent dewaxing, and base oils refined by the Mobil Wax isomerisation process.

In addition to lubricant base oils belonging to Group 3, the base oil composition of the invention may also include lubricant base oils belonging to Groups 1-2 and 4-5.

The viscosity index of the base oil composition of the invention is preferably not less than 120, but more preferably not less than 130. If the viscosity index is below 120, the viscosity will be too high at low temperatures, and there will be concerns that engine friction due to the higher viscous resistance will increase, so that fuel-consumption performance of the engine will be reduced. The viscosity index is calculated from the values obtained by measuring the kinematic viscosities at 40° and 100° in accordance with JIS K2283 (2000). The kinematic viscosity at 100° C. of the base oil composition of this invention is not specially restricted but will preferably be 2 to 12 $mm^2/s$, but more preferably 3 to 12 $mm^2/s$ and still more preferably 5 to 12 $mm^2/s$. If the kinematic viscosity at 100° C. is below 2 $mm^2/s$, it will be necessary to use lots of viscosity index improver in order to obtain the kinematic viscosity needed of the base oil composition, and in that case there will be concerns over deterioration of the shear stability. However, if the kinematic viscosity at 100° C. exceeds 12 $mm^2/s$, the kinematic viscosity at low temperatures will become high and viscous resistance will increase, so that it will be difficult to reduce engine friction. The kinematic viscosity at 40° C. of the base oil composition of this invention is not specially restricted but will preferably be 5 to 60 $mm^2/s$, but more preferably 10 to 55 $mm^2/s$ and still more preferably 15 to 50 $mm^2/s$. As mentioned above, the kinematic viscosities at 40° C. and 100° C. may be measured in accordance with JIS K 2283 (2000).

The % Cp in the base oil composition of the invention is preferably not less than 90%, but more preferably not less than 92%. If the % Cp is below 90%, the viscosity index of the base oil will decrease, and large amounts of viscosity index improver will be necessary in order to raise the viscosity index of the lubricating oil. For that reason, a detrimental effect will be imparted to high-temperature detergency and shear stability. It is also undesirable in that oxidative stability will worsen. The % Cp of the base oil in this invention is measured in accordance with n-d-M analysis: ASTM D3238. What is meant by % Cp is the proportion (percentage) of the paraffinic element calculated by the n-d-M method in ring analysis, and is measured in accordance with ASTM D-3238.

The amount of lubricant base oil belonging to Group 3 in the base oil composition of the invention is not specially restricted, but to give an indicative range it will be not less than 70 weight % in terms of the total amount of the base oil composition, and preferably not less than 80 weight % or more preferably not less than 90 weight %. If lubricant base oils belonging to Groups 1-2 and 4-5 are included in the base oil composition, there are no special restrictions but, to give an indicative range, they will preferably be not more than 15 weight % in terms of the total amount of the base oil composition.

The amount of base oil composition incorporated in the lubricating oil composition of the invention is not specially restricted, but to give an indicative range it will be 50 to 90 mass % in terms of the total amount of the lubricating oil composition, and preferably 60 to 90 mass % or more preferably 70 to 85 mass %.

The comb-like polymethacrylate-based viscosity index improver used in the lubricating oil composition of this invention is one characterised in that the weight-halving temperature is not less than 310° C.

A "comb polymer" here is one known in the art of the relevant industries, and refers to a polymer which has three-way branch points connecting branching parts (branch polymer chains) to a core part (core polymer chain), and said branched parts themselves also have three-way branch points connecting the side chains to the main chain. In other words, a "comb polymer" is a general designation for polymers having a plurality of side chains extended from a main chain in a comb formation.

The comb-like polymethacrylate-based viscosity index improver referred to in this invention refers to a polymethacrylate (PMA)-based viscosity index improver which is a comb polymer. Comb-like polymethacrylate-based viscosity index improvers are known in the art of the relevant industries, for example as disclosed WO2010532805 and WO2013536293.

The comb-like polymethacrylate-based viscosity index improvers pertaining to the form of embodiment of this invention may be, for instance, methacrylate-based macromonomers and comb-structure polymers (comb polymers) obtained by copolymerisation of methacrylate-based monomers. Said comb-like polymethacrylate-based viscosity index improvers may also be comb polymers formed of a polyalkyl(meth)acrylate-based main chain and long hydrocarbon side chains with a carbon number of at least 50.

In addition, the comb-like polymethacrylate-based viscosity index improvers pertaining to the form of embodiment of this invention may be, for example, polymers which have the monomer constituent formed only of methacrylate-based monomers, or copolymers of methacrylate-based monomers and other monomers, or those incorporating macromolecular compounds other than polymethacrylates in part of the structure. Further, said comb-like polymethacrylate-based viscosity index improvers may be of the dispersive type having polar groups such as amino groups or sulphonic acid groups in their molecular structure, or the non-dispersive type not containing these. In the aforementioned, the amount of methacrylate-based monomers is ideally not less than 70 weight % in terms of the total amount of the above-mentioned comb-like polymethacrylate-based viscosity index improver, but more ideally not less than 80 weight % and still more ideally not less than 90 weight %.

Next, what is meant by the "weight-halving temperature" refers to the temperature in thermogravimetric analysis at which the weight of the sample is halved. The above-mentioned thermogravimetric analysis measures the reduction in weight when the temperature is raised at 10° C./minute from normal temperature (of the order of 25° C.) up to 500° C. in an $N_2$ atmosphere. A simultaneous thermogravimetry and differential thermal analysis apparatus (machine model: TG/DTA6200, manufacturer's name: Hitachi High-Tech Science Corporation) is used for the measurement.

The weight-halving temperature of the comb-like polymethacrylate-based viscosity index improver of the invention must be not less than 310° C., and preferably not less than 320° C. or still more preferably not less than 380° C. In line with the downsizing of engines as the trend for lower fuel consumption continues, the thermal load of the engine oil in the area of the pistons is rising and there will be cases where piston parts in contact with the oil are in the vicinity of 300° C. Consequently, whilst the heat-resistant temperatures of macromolecular viscosity index improvers, which are prone to carbonisation, do improve fuel-saving characteristics in particular, it is the heat-resistant temperatures of polymethacrylate-based viscosity index improvers which are the important factor in protecting engines where products of decomposition would have a deleterious effect on metallic parts. With polymethacrylate-based viscosity index improvers where the weight-halving temperature in thermogravimetric analysis is not less than 310° C., decomposition products are unlikely to be produced inside the engines, and so are unlikely to have deleterious effects such as corrosion on metallic parts. Also, if the weight-halving temperature is below 310°, decomposition is likely to occur inside the engine and the compounds formed by decomposition will react with parts within the engine, promoting corrosion, which aspect is not desirable.

The comb-like polymethacrylate-based viscosity index improver of the invention should also ideally have a weight average molecular weight of 200,000 to 600,000, but more ideally 250,000 to 500,000 and most ideally 300,000 to 450,000. As regards the weight average molecular weight, the average molecular weights (weight average molecular weight at polystyrene conversion and number average molecular weight) can be analysed (calculated) by using for example a Shodex GPC-101 high-speed liquid chromatograph as made by Showa Denko Ltd, the measuring conditions being a temperature of 40° C., a detector of the differential refractive index (RI) type, a carrier flow rate of THF-1.0 ml/min (ref. 0.3 ml/min), injected sample amount of 100 μl and columns of types KF-G (Shodex×1) and KF-805L (Shodex×2), and by using a range appropriate to the peak molecular weights.

For the comb-like polymethacrylate-based viscosity index improver of the invention, as mentioned above it is possible to use either the non-dispersive or dispersive types. Under high-temperature high-shear conditions, from the standpoint of inhibiting accumulation of deposits adhering to pistons, and so having high piston detergency, it is preferable to use the non-dispersive type of comb-like polymethacrylate-based viscosity index improver.

The method of manufacture of comb-like polymethacrylate-based viscosity index improvers is known in the art of the relevant industries. For example, it is possible to manufacture polymers of comb-like structure (comb-like polymethacrylate based viscosity index improvers) obtained by copolymerisation of methacrylate-based macromonomers and methacrylate-based monomers by following the methods of manufacture disclosed in the WO2010532805 and WO2013536293. Then, by following the thermogravimetric analysis mentioned above, those acquainted with the art can make an appropriate selection of comb-like polymethacrylate-based viscosity index improvers where the weight-halving temperature is not less than 310° C. from the polymethacrylate-based viscosity index improvers so manufactured.

Comb-like polymethacrylate-based viscosity index improvers where the weight-halving temperature is not less than 310° C. can also be procured as commercial products.

The lubricating oil composition of the invention may also contain viscosity index improvers other than comb-like polymethacrylate-based viscosity index improvers. As examples of such viscosity index improvers, mention may be made of polymers of one kind or more selected from a group comprised of non-comb-like PMA (polymethacrylate)-based viscosity index improvers, OCP (olefin copolymer)-based viscosity index improvers and SCP (styrene diene copolymers)-based viscosity improvers.

There are no special restrictions for non-comb-like PMA (polymethacrylate)-based viscosity index improvers and it is possible to use those known in the art, but it is ideal if the weight average molecular weight is 100,000 to 400,000. Specific examples of such a non-comb-like PMA-based viscosity index improver are those disclosed in Japanese Laid-open Patent 2014-125569.

There are no special restrictions for OCP (olefin copolymer)-based viscosity index improvers and it is possible to use those known in the art, but it is ideal if the weight average molecular weight is 50,000 to 300,000. Specific examples of such an OCP-based viscosity index improver are those disclosed in Japanese Laid-open Patent 2014-125569.

There are no special restrictions for SCP (styrene diene copolymer)-based viscosity index improvers and it is possible to use those known in the art, but it is ideal if the weight average molecular weight is 200,000 to 1,000,000. A specific example of such an SCP-based viscosity index improver is Infineum (registered trade mark) SV150.

The lubricating oil composition of this invention may contain, as viscosity index improvers, comb-like polymers other than comb-like polymethacrylates.

In order to make such viscosity index improvers (polymers wherein the weight average molecular weight is at least 50,000) easier to handle, they may be incorporated in diluted form in a suitable liquid medium.

There are no special restrictions on the incorporated amount of viscosity index improvers (amount of viscosity index improvers as a whole), and it can be varied as appropriate, but it will typically be 0.05 to 20 weight % in terms of the total mass of the lubricating oil composition. The proportion of comb-like polymethacrylate-based viscosity index improver in the totality of viscosity index improvers will be greater than 0% and up to 100%.

The sulphur content in the lubricating oil of the invention must be not more than 0.3 weight % in terms of the total amount of the lubricating oil composition, and will more preferably be not more than 0.275 weight % or more preferably still not more than 0.25 weight %. The sulphur content in the lubricating oil composition may even be 0 weight %. If the sulphur content is not more than 0.3 weight %, the effect will be that sulphides will be unlikely to form with internal parts of the engine, in particular copper alloys. But if the sulphur content exceeds 0.3 weight %, sulphides will be likely to form in reactions with the internal parts of the engine, which is not desirable.

The amount of sulphur in the lubricating oil composition of the invention is the value as measured by using the ultraviolet fluorescence method (ASTM D4294).

The sulphated ash content in the lubricating oil composition of this invention is preferably not more than 0.6 weight % in terms of the total amount of the lubricating oil composition, but more preferably not more than 0.55 weight % and yet more preferably not more than 0.50 weight %. If the sulphated ash content is not more than 0.6 weight %, the effect is to reduce clogging of the DPF, which is a post-treatment apparatus installed to eliminate soot occurring in the combustion chamber. If the sulphated ash content is greater than 0.6 weight %, however, there is the drawback that clogging of the DPF becomes more likely to occur. If clogging of the DPF becomes excessive, this will be associated with an increase in the amount of fuel consumed, and so will be detrimental to fuel consumption, because the frequency of forced combustion of the soot accumulated within the DPF through piston atomisation of the fuel will increase.

The amount of sulphated ash in the lubricating oil composition of the invention is the value as measured in accordance with ASTM D874.

Where necessary, it is possible also to include anti-oxidants, friction modifiers, rust inhibitors, corrosion inhibitors, defoaming agents and the like in the lubricating oil composition pertaining to the invention. It is also possible to make use of additives packages in which additives such as ashless dispersants, metallic detergents, zinc alkyldithiophosphates and anti-oxidants are made into pre-packaged mixtures, and the aforementioned additives and packages may also be used together.

As to the method of manufacture of the lubricating oil composition of this invention, the base oils, viscosity index improvers and, where added as necessary, the aforementioned additives may be mixed as appropriate, there being no special restriction on the mixing sequence.

The viscosity index of the lubricating oil composition of the invention must be not less than 185. Said viscosity index is preferably not less than 200 and more preferably not less than 210. If the viscosity index is below 185, the viscosity at low temperatures will be high and there will be concerns that engine friction due to increased viscous resistance will rise and fuel consumption performance will decrease. The viscosity index is calculated from the values obtained by measuring the kinematic viscosities at 40° C. and 100° C. in accordance with JIS K2283 (2000).

The kinematic viscosity at 100° C. of the lubricating oil composition of the invention is not specially restricted, but is preferably 2 to 12 $mm^2/s$, more preferably 3 to 12 $mm^2/s$ and yet more preferably 5 to 12 $mm^2/s$. If the kinematic viscosity at 100° C. is below 2 $mm^2/s$, it will be necessary to use large quantities of viscosity index improvers so as to obtain the kinematic viscosity required of the lubricating oil composition, and in that case there will be concerns over deterioration of shear stability. However, if the kinematic viscosity at 100° C. exceeds 12 $mm^2/s$, the kinematic viscosity at low temperatures will become high and viscous resistance will increase, so that it will be difficult to reduce engine friction. The kinematic viscosity at 40° C. of the lubricating oil composition of this invention is not specially restricted, but will be 5 to 60 $mm^2/s$ and more preferably 10 to 55 $mm^2/s$. 15 to 50 $mm^2/s$ is yet more preferable. As mentioned above, the kinematic viscosities at 40° C. and 100° C. may be measured in accordance with JIS K2283 (2000).

The SAE viscosity grade of the lubricating oil composition of the invention is 0W-20, 5W-20 or 5W-30. These SAE viscosity grades can be expected to have the effect of reducing fuel consumption because of their high viscosity index. When the viscosity is adjusted at blending time, it is desirable to adjust the blended amounts so as to match these SAE viscosity grades.

The high-temperature high-shear viscosity (HTHS viscosity) at 100° C. of the lubricating oil composition of this invention must be not more than 7.5 mPa·s. Said high-temperature high-shear viscosity is preferably not more than 5.0 mPa·s and more preferably not more than 3.0 mPa·s. If the high-temperature high-shear viscosity at 100° C. is not more than 7.5 mPa·s, superior fuel economising performance can be achieved. However, if the high-temperature high-shear viscosity at 100° C. exceeds 7.5 mPa·s, there is a risk that improving fuel economising properties will be too difficult. The high-temperature high-shear viscosity at 100° C. is measured by the capillary method and is the value measured in accordance with the test method of ASTM D5481, the temperature condition being set at 100° C. (shear velocity $1.0*10^6$).

The lubricating oil composition pertaining to this invention not only exhibits corrosion resistance but also manifests superior results as regards shear stability and fuel economy. The various properties of the lubricating oil composition pertaining to the invention are explained below.

An aged oil was created with a view to decomposing the viscosity index improvers in a high-temperature detergency test (piston coking test, test apparatus as disclosed in Japanese Patent 4133133 (Chevron Japan Ltd., Lubricating Oil Sedimentation Testing Device of Piston Undercrown). The test conditions were piston temperature 300° C., oil temperature 120° C., oil amount 250 ml, emitted amount 15 ml/minute. After the high-temperature detergency test, a copper strip was immersed in the aged oil and the copper corrosiveness of the oil was evaluated. The test conditions were oil temperature 140° C. and oil amount 30 ml, and ISOT-type copper plate cut into 1 cm×1.5 cm strips was used for the copper strips. The concentration of copper in the oil was measured in accordance with test method JPI 5S-44-11. It is believed that a superior copper corrosion resistance function will be obtained if the copper concentration in the oil after a copper strip corrosion test in aged oil is less than 20 ppm. The undermentioned examples of embodiment and comparative examples were marked 0 if the copper concentration in the oil after the copper corrosion test was below 20 ppm and X if it exceeded 20 ppm.

The high-temperature high-shear viscosity (HTHS viscosity) at 100° C. for when the viscosity grade was set at 0W-20, 5W-20 or 5W-30 was determined. As described in the literature (Trends in Environmental Diesel Engines, Tribologist, 59 (2014) 387), it has been reported that there is a good relationship between improvements in fuel consumption and the HTHS viscosity at 100° C. It is believed that superior fuel economising properties can be obtained with an HTHS viscosity at 100° C. lower than 7.5 mPa·s. The HTHS viscosity here is measured by the capillary method and is the value measured in accordance with the test method of ASTM D5481, the temperature condition being set at 100° C. (shear velocity $1.0*10^6$). The undermentioned examples of embodiment and comparative examples were marked 0 for not more than 7.5 mPa·s at HTHS 100° C. viscosity and X for exceeding 7.5 mPa·s.

Shear stability is evaluated in terms of the reduction in kinematic viscosity at 100° C. after a test on the kinematic viscosity at 100° C. after and before a 300-cycle test by the diesel injector method in accordance with ASTM D6278. The smaller this value is, the better is the shear stability. The value for the reduction in kinematic viscosity in the shear stability test is ideally not more than 2%. In the aforementioned examples of embodiment and comparative examples, the reduction in kinematic viscosity at 100° C. after a Bosch stability test was marked 0 if it was not more than 2% and X if it exceeded 2%.

The lubricating oil composition of this invention can be applied to various kinds of engines. It is not restricted to uses in petrol engines, diesel engines or gas engines, but it can be used for preference in petrol engines and diesel engines.

In this invention it has been discovered that it is possible to exhibit superior results in terms of not just fuel economy but also copper corrosion resistance and shear stability by incorporating a specific base oil and a specific viscosity index improver in the lubricating oil composition, by setting the sulphur content below a specific value, setting a specific SAE viscosity grade, setting the viscosity index at a specific minimum value and setting the viscosity at a specific maximum value. By raising the thermal decomposition temperature of the polymethacrylate-based viscosity index improver, the acids which are created by decomposition of the polymethacrylate react with the copper in the engine parts and leaching out of the copper is promoted. Also, a higher sulphur concentration in the lubricating oil composition promotes sulphur reacting with the copper and leaching it out. Alternatively, it may be considered that sulphur compounds promote oxidation and ageing of the lubricating oil and acids created by oxidation and ageing react with the copper, promoting copper corrosion. It is conjectured that these actions act synergistically in a complex way. Said effects are synergistic effects furnished by the aforementioned specific combination, and were completely unforeseen effects.

The invention is next explained in more detail by means of examples of embodiment and comparative examples, but it is in no way limited by these examples.

Raw Materials

The raw materials used in the examples pf embodiment were as follows.

Base oil A: a base oil belonging to Group 3, having been obtained by Fischer-Tropsch synthesis, wherein the kinematic viscosity at 40° C. was 17.94 $mm^2/s$, the kinematic viscosity at 100° C. was 4.053 $mm^2/s$, the viscosity index was 127 and the % Cp was 93.2.

Base oil B: a base oil belonging to Group 3, having been obtained by Fischer-Tropsch synthesis, wherein the kinematic viscosity at 40° C. was 43.70 $mm^2/s$, the kinematic viscosity at 100° C. was 7.580 $mm^2/s$, the viscosity index was 141 and the % Cp was 91.4.

Base oil C: a base oil belonging to Group 1, wherein the kinematic viscosity at 40° C. was 25.20 $mm^2/s$, the kinematic viscosity at 100° C. was 4.727 $mm^2/s$, the viscosity index was 106 and the % Cp was 68.1.

Base oil D: a base oil belonging to Group 1, wherein the kinematic viscosity at 40° C. was $mm^2/s$, the kinematic viscosity at 100° C. was 95.02 $mm^2/s$, the viscosity index was 11.13 and the % Cp was 69.5.

Additives package: package appropriate to DL-1 where the sulphated ash content when 11.7% is added is 0.46%.

Anti-wear agent: a secondary dialkyldithiophosphate of zinc was used here as a wear-resisting agent, with alkyl groups of carbon numbers 4 and 6 being attached and the phosphorus content being 7.2 mass % and the zinc content 7.7 mass %.

Viscosity index improver solution A (comb-like polymethacrylate-based viscosity index improver): a non-dispersive comb-like polymethacrylate-based viscosity index improver whereof the weight average molecular weight was 400,000 and the weight-halving temperature was 320° C.

Viscosity index improver solution B (comb-like polymethacrylate-based viscosity index improver): a non-dispersive comb-like polymethacrylate-based viscosity index improver whereof the weight average molecular weight was 400,000 and the weight-halving temperature was 380° C.

Viscosity index improver solution C (comb-like polymethacrylate-based viscosity index improver): a non-dispersive comb-like polymethacrylate-based viscosity index improver whereof the weight average molecular weight was 400,000 and the weight-halving temperature was 300° C.

Viscosity index improver solution D (comb-like polymethacrylate-based viscosity index improver): a non-dispersive comb-like polymethacrylate-based viscosity index improver whereof the weight average molecular weight was 150,000 and the weight-halving temperature was 300° C.

Viscosity index improver solution E (olefin copolymer-based viscosity index improver): a non-dispersive olefin copolymer-based viscosity index improver whereof the weight average molecular weight was 150,000 and the weight-halving temperature was 450° C.

DCF 3 mass % solution: A polymethylsiloxane (silicone oil) of approximate weight average molecular weight 30,000 dissolved to 3 mass % in a JIS No. 1 kerosene was used as a defoaming agent.

The lubricating oil compositions pertaining to Examples of Embodiment 1 to 5 and Comparative Examples 1 to 5 were obtained by blending the above-mentioned raw materials as per Tables 1 and 2.

Tests in respect of copper corrosion resistance, fuel economy and shear stability were carried out on the examples of embodiment and comparative examples using the above-mentioned test methods. Cu corrosion (*), fuel economy (*) and shear stability (*) in Tables 1 and 2 have the following meanings.

Cu corrosion (*): where the amount of Cu leached out in the Cu corrosion test is not more than 20 ppm . . . O Fuel economy (*): where is not more than 7.5 mPa·s at HTHS 100° C. viscosity . . . O Shear stability (*): where ΔVk100 in the Bosch shear test is not more than 2% . . . O Results On the basis of the results in Table 1, Examples of Embodiment 1 to 5 pertaining to the invention were all excellent as regards copper corrosion resistance, fuel economy and shear stability.

In contrast, referring to Table 2, Comparative Example 1 exhibited inferior copper corrosion resistance for the case when the weight-halving temperature was below 310° C., even though using a comb-like polymethacrylate-based viscosity index improver.

Comparative Example 2 exhibited inferior copper corrosion resistance and shear stability when using a non-comb-like polymethacrylate-based viscosity index improver.

Comparative Example 3 exhibited inferior shear stability when using an olefin copolymer-based viscosity index improver, even though it was a viscosity index improver with a weight-halving temperature of more than 310° C.

Comparative Example 4 exhibited inferior copper corrosion resistance and fuel economy for the case where, in using a base oil belonging to Group 1, the sulphur content was more than 0.3 weight %, even though a comb-like polymethacrylate-based viscosity index improver with a weight-halving temperature of more than 310° C. was used.

Comparative Example 5 exhibited inferior copper corrosion resistance and fuel economy for the case where a comb-like polymethacrylate-based viscosity index improver with a weight-halving temperature below 310° C. was used and the sulphur content was more than 0.3 weight %.

On the basis of the foregoing points it can be seen that the excellent results in respect of all of copper corrosion resistance, fuel economy and shear stability are synergistic results furnished by the specific combination pertaining this invention.

TABLE 1

| | Emb. Ex. 1 | Emb. Ex. 2 | Emb. Ex. 3 | Emb. Ex. 4 | Emb. Ex. 5 |
|---|---|---|---|---|---|
| Base oil A | 51.00 | 55.66 | 64.90 | 53.32 | 51.00 |
| Base oil B | 34.27 | 27.41 | 20.00 | 22.85 | 24.30 |
| Base oil C | | | | | |
| Base oil D | | | | | 10.00 |

TABLE 1-continued

| | | Emb. Ex. 1 | Emb. Ex. 2 | Emb. Ex. 3 | Emb. Ex. 4 | Emb. Ex. 5 |
|---|---|---|---|---|---|---|
| Additives package | | 11.70 | 11.70 | 11.70 | 11.70 | 11.70 |
| Anti-wear agent | | 0.10 | 0.10 | 0.10 | 0.10 | 0.10 |
| Viscosity index improver solution A (comb PMA) | | 2.90 | 5.10 | 3.30 | | 2.90 |
| Viscosity index improver solution B (comb PMA) | | | | | 12.00 | |
| Viscosity index improver solution C (comb PMA) | | | | | | |
| Viscosity index improver sol. D (non-comb PMA) | | | | | | |
| Viscosity index improver sol. E (olefin copolymer) | | | | | | |
| Defoaming agent | | 0.03 | 0.03 | 0.03 | 0.03 | 0.03 |
| | | 100.00 | 100.00 | 100.00 | 100.00 | 100.00 |
| Cu corrosion (*) | | ○ | ○ | ○ | ○ | ○ |
| Fuel economy (*) | | ○ | ○ | ○ | ○ | ○ |
| Shear stability (*) | | ○ | ○ | ○ | ○ | ○ |
| Viscosity grade | | 5W-20 | 5W-30 | 0W-20 | 5W-20 | 5W-20 |
| Vk40° C. | $mm^2/s$ | 42.08 | 42.42 | 37.57 | 43.80 | 44.87 |
| Vk100° C. | $mm^2/s$ | 8.88 | 11.00 | 8.50 | 8.91 | 9.25 |
| VI | | 198 | 264 | 214 | 190 | 195 |
| CCS-35° C. | mPa · s | | | 5500 | | |
| CCS-30° C. | mPa · s | 3700 | 4500 | | 3500 | 4350 |
| CCS-25° C. | mPa · s | | | | | |
| HTHS100° C. | mPa · s | 6.6 | 7.4 | 6.4 | 6.8 | 6.6 |
| Ca | mass % | 0.093 | 0.093 | 0.093 | 0.093 | 0.093 |
| Mg | mass % | <0.001 | <0.001 | <0.001 | <0.001 | <0.001 |
| Zn | mass % | 0.091 | 0.091 | 0.091 | 0.091 | 0.091 |
| P | mass % | 0.078 | 0.078 | 0.078 | 0.078 | 0.078 |
| Mo | mass % | 0.011 | 0.011 | 0.011 | 0.011 | 0.011 |
| B | mass % | 0.011 | 0.011 | 0.011 | 0.011 | 0.011 |
| N | mass % | 0.100 | 0.100 | 0.100 | 0.100 | 0.100 |
| S | mass % | 0.24 | 0.25 | 0.25 | 0.25 | 0.30 |
| S-ash | mass % | 0.46 | 0.46 | 0.46 | 0.46 | 0.46 |
| Vk100 reduction after Bosch shear test | % | −1.8 | −2.0 | −2.0 | −1.5 | −1.8 |
| Cu concentration in oil after Cu corrosion test | ppm | 15 | 14 | 15 | 15 | 15 |
| VM (after removal of diluent) weight-halving temperature in $N_2$ atmosphere | ° C. | 320 | 320 | 320 | 380 | 320 |

TABLE 2

| | Comp. Ex. 1 | Comp. Ex. 2 | Comp. Ex. 3 | Comp. Ex. 4 | Comp. Ex. 5 |
|---|---|---|---|---|---|
| Base oil A | 54.72 | 59.34 | 59.06 | | |
| Base oil B | 23.45 | 25.43 | 17.72 | | |
| Base oil C | | | | 80.30 | 73.20 |
| Base oil D | | | | 5.00 | 5.00 |
| Additives package | 11.70 | 11.70 | 11.70 | 11.70 | 11.70 |
| Anti-wear agent | 0.10 | 0.10 | 0.10 | 0.10 | 0.10 |
| Viscosity index improver solution A (comb PMA) | | | | 2.90 | |
| Viscosity index improver solution B (comb PMA) | | | | | |
| Viscosity index improver solution C (comb PMA) | 10.00 | | | | 10.00 |
| Viscosity index improver sol. D (non-comb PMA) | | 3.40 | | | |

TABLE 2-continued

| | | Comp. Ex. 1 | Comp. Ex. 2 | Comp. Ex. 3 | Comp. Ex. 4 | Comp. Ex. 5 |
|---|---|---|---|---|---|---|
| Viscosity index improver sol. E (olefin copolymer) | | | | 3.80 | | |
| Defoaming agent | | 0.03 | 0.03 | 0.03 | 0.03 | 0.03 |
| | | 100.00 | 100.00 | 100.00 | 100.00 | 100.00 |
| Cu corrosion (*) | | x | x | ○ | x | x |
| Fuel economy (*) | | ○ | ○ | ○ | x | x |
| Shear stability (*) | | ○ | x | x | ○ | ○ |
| Viscosity grade | | 5W-20 | 5W-20 | 5W-20 | 10W-30 | 10W-30 |
| Vk40° C. | $mm^2/s$ | 40.98 | 43.02 | 48.28 | 52.40 | 51.34 |
| Vk100° C. | $mm^2/s$ | 8.81 | 8.80 | 8.75 | 10.06 | 11.59 |
| VI | | 199 | 190 | 162 | 183 | 228 |
| CCS-35° C. | mPa · s | | | | | |
| CCS-30° C. | mPa · s | 3800 | 4000 | 3900 | | |
| CCS-25° C. | mPa · s | | | | 4600 | 4650 |
| HTHS100° C. | mPa · s | 6.8 | 7.0 | 7.4 | 8.1 | 8.6 |
| Ca | mass % | 0.093 | 0.093 | 0.093 | 0.093 | 0.093 |
| Mg | mass % | <0.001 | <0.001 | <0.001 | <0.001 | <0.001 |
| Zn | mass % | 0.091 | 0.091 | 0.091 | 0.091 | 0.091 |
| P | mass % | 0.078 | 0.078 | 0.078 | 0.078 | 0.078 |
| Mo | mass % | 0.011 | 0.011 | 0.011 | 0.011 | 0.011 |
| B | mass % | 0.011 | 0.011 | 0.011 | 0.011 | 0.011 |
| N | mass % | 0.100 | 0.100 | 0.100 | 0.100 | 0.100 |
| S | mass % | 0.25 | 0.24 | 0.25 | 0.62 | 0.65 |
| S-ash | mass % | 0.46 | 0.46 | 0.46 | 0.46 | 0.46 |
| Vk100 reduction after Bosch shear test | % | −1.8 | −8.5 | −7.5 | −1.9 | −2.0 |
| Cu concentration in oil after Cu corrosion test | ppm | 41 | 45 | 12 | 55 | 103 |
| VM (after removal of diluent) weight-halving temperature in $N_2$ atmosphere | ° C. | 300 | 300 | 450 | 320 | 300 |

The invention claimed is:

1. A lubricating oil composition comprising:

(a) a base oil composition comprising a lubricant base oil belonging to Group 3 of the base oil categories specified by the American Petroleum Institute (API); and (b) a comb-like polymethacrylate-based viscosity index improver having a weight-halving temperature of at least 310° C., and wherein the lubricating oil composition has a sulphur content of at most 0.3 weight % in terms of the total weight of the lubricating oil composition, an SAE viscosity grade of 0W-20, 5W-20 or 5W-30, a viscosity index of at least 185, and a high-temperature high-shear viscosity at 100° C. of at most 7.5 mPa·s.

2. The lubricating oil composition in accordance with claim 1 wherein the viscosity index of the base oil composition is at least 120.

3. The lubricating oil composition in accordance with claim 1 wherein a % Cp of the base oil composition on the basis of ASTM D3238 is at least 90%.

4. The lubricating oil composition in accordance with claim 1 wherein the weight-halving temperature of the comb-like polymethacrylate based viscosity index improver is at least 320° C.

5. The lubricating oil composition in accordance with claim 1 wherein the sulphur content of the lubricating oil composition is at most 0.25 weight % in terms of the total weight of the lubricating oil composition.

6. The lubricating oil composition in accordance with claim 1 wherein a sulphated ash content of the lubricating oil composition is at most 0.6 weight % in terms of the total weight of the lubricating oil composition.

7. The lubricating oil composition in accordance with claim 1 wherein the comb-like polymethacrylate-based viscosity index improver comprises at least 70% methacrylate.

8. The lubricating oil composition in accordance with claim 7 wherein the viscosity index of the base oil composition is greater than 120.

9. The lubricating oil composition in accordance with claim 7 wherein a % Cp of the base oil composition on the basis of ASTM D3238 is at least 90%.

10. The lubricating oil composition in accordance with claim 7 wherein the weight-halving temperature of the comb-like polymethacrylate based viscosity index improver is at least 320° C.

11. The lubricating oil composition in accordance with claim 7 wherein the sulphur content of the lubricating oil composition is at most 0.25 weight % in terms of the total weight of the lubricating oil composition.

12. The lubricating oil composition in accordance with claim 7 wherein a sulphated ash content of the lubricating oil composition is at most 0.6 weight % in terms of the total weight of the lubricating oil composition.

* * * * *